US007614934B2

(12) United States Patent
Onishi et al.

(10) Patent No.: US 7,614,934 B2
(45) Date of Patent: Nov. 10, 2009

(54) DOUBLE-SIDE POLISHING APPARATUS

(75) Inventors: Susumu Onishi, Nagano (JP); Masashi Maruta, Nagano (JP)

(73) Assignee: Fujikoshi Machinery Corp., Nagano-Shi (JP)

( * ) Notice: Subject to any disclaimer, the term of this patent is extended or adjusted under 35 U.S.C. 154(b) by 0 days.

(21) Appl. No.: 12/076,061

(22) Filed: Mar. 13, 2008

(65) Prior Publication Data

US 2008/0227371 A1 Sep. 18, 2008

(30) Foreign Application Priority Data

Mar. 15, 2007 (JP) ..... 2007-066964

(51) Int. Cl.
*B24B 49/00* (2006.01)
*B24B 51/00* (2006.01)

(52) U.S. Cl. ..... 451/6; 451/8; 451/262; 451/267

(58) Field of Classification Search ..... 451/5, 451/6, 8, 9, 10, 11, 262, 263, 264, 265, 266, 451/267, 268, 269
See application file for complete search history.

(56) References Cited

U.S. PATENT DOCUMENTS 4,197,676 A * 4/1980 Sauerland ..... 451/1
4,199,902 A * 4/1980 Sauerland ..... 451/1
4,272,924 A * 6/1981 Masuko et al. ..... 451/1
4,433,510 A * 2/1984 Katagiri et al. ..... 451/5
5,099,614 A * 3/1992 Arai et al. ..... 451/8
5,499,733 A 3/1996 Litvak
5,969,521 A * 10/1999 Kurita et al. ..... 324/229
7,137,867 B2 * 11/2006 Nagayama et al. ..... 451/5
7,147,541 B2 * 12/2006 Nagayama et al. ..... 451/5
7,413,832 B2 * 8/2008 Koike et al. ..... 430/5
2004/0192171 A1 * 9/2004 Koike ..... 451/5
2004/0198186 A1 10/2004 Nishikawa et al.

FOREIGN PATENT DOCUMENTS

JP 7-52032 A 2/1995
JP 2005-19920 A 1/2005

* cited by examiner

*Primary Examiner*—Timothy V Eley
(74) *Attorney, Agent, or Firm*—Birch, Stewart, Kolasch & Birch, LLP

(57) ABSTRACT

The double-side polishing apparatus for polishing both faces of a wafer is capable of reliably measuring not only a thickness of an outer part of the wafer but also a thickness of a center part thereof. The double-side polishing apparatus comprises: a lower polishing plate; an upper polishing plate held by a frame; and a carrier having a through-hole for holding the wafer. A window section, through which a laser beam passes, is formed in a part of the upper polishing plate, under which the wafer held by the carrier passes. An optical thickness measuring equipment is provided to a part of the frame, under which the window section passes while the upper polishing plate is rotated. The thickness measuring equipment emits the laser beam through the window section, receives reflected beams reflected from an upper face and a lower face of the wafer, and calculates the thickness of the wafer on the basis of peak values of the reflected beams.

6 Claims, 3 Drawing Sheets

DOUBLE-SIDE POLISHING APPARATUS

BACKGROUND OF THE INVENTION

The present invention relates to a double-side polishing apparatus, more precisely relates to a double-side polishing apparatus capable of measuring a thickness of a wafer while polishing the wafer.

A conventional double-side polishing apparatus for polishing both faces of a wafer comprises: a lower polishing plate whose upper face acts as a polishing face; an upper polishing plate whose lower face acts as a polishing face; a frame holding the upper polishing plate above the lower polishing plate, the frame vertically moving the upper polishing plate; a carrier being provided between the lower polishing plate and the upper polishing plate, the carrier having a through-hole, in which the wafer is held; a plate driving unit for rotating the lower polishing plate and the upper polishing plate about their axes; a carrier driving unit for rotating the carrier; and a slurry supply unit. The lower polishing plate, the upper polishing plate and the carrier are rotated with supplying slurry to the lower polishing plate so as to polish the both faces (the lower face and the upper face) of the wafer with the both polishing plates.

These days, polishing accuracy (thickness) of wafers must be higher and higher.

In a conventional double-side polishing method, firstly a polishing rate is measured by polishing a sample wafer or wafers. Next, a required time for polishing an object wafer until reaching a prescribed thickness at the measured polishing rate is calculated, and then the object wafer is polished for the calculated required time. However, the polishing rate is varied by some conditions, e.g., a surface condition of a polishing cloth, so a thickness of wafers of one batch is different from that of other batches. This problem can be solved by calculating the polishing rate of a sample wafer for each batch, but it takes a long time and it is inefficient.

To solve the problem, methods for measuring a thickness of a wafer during a polishing process have been proposed.

In Japanese Patent Gazette No. 7-52032, transparent plates are fitted to some of through-holes bored in a lower polishing plate, and a light-reflecting condition of a polished surface of a wafer is continuously monitored while polishing the wafer so as to detect completion of a film polishing process.

In Japanese Patent Gazette No. 2005-19920, an optical measuring equipment is provided on a polishing plate, which acts as a rotating section, with an optical fiber rotary joint, and a thickness of a wafer is measured through a transparent window of an upper polishing plate.

The wafer thickness measuring equipments of Japanese Patent Gazette No. 7-52032 and Japanese Patent Gazette No. 2005-19920 are shown in one drawing of FIG. 5.

In FIG. 5, a symbol 100 stands for a lower polishing plate; a symbol 101 stands for a motor for driving the lower polishing plate 100; and a symbol 102 stands for a bearing for supporting the lower polishing plate 100. A symbol 103 stands for an upper polishing plate, which is connected to a suspended plate 105 by connecting pillars 104; a symbol 106 stands for a driving section for driving the upper polishing plate 103; and a symbol 107 stands for a motor for driving the upper polishing plate 103. A symbol 108 stands for a slurry supply pipe; a symbol 109 stands for a ring-shaped conduit; and a symbol 110 stands for a slurry supply tube.

The thickness measuring equipment 111 (disclosed in Japanese Patent Gazette No. 7-52032) is provided on the lower polishing plate 100 side and emits a measuring light 113 through a transparent window 112 of the lower polishing plate 100 so as to measure a thickness of the wafer W.

The other thickness measuring equipment 114 (disclosed in Japanese Patent Gazette No. 2005-19920) is provided on the upper polishing plate 103 side, emits a measuring light 113 toward the wafer W through a transparent window 115 of the upper polishing plate 103 and introduces a reflected light to outside via a fiber cable 116, which is passed through a rotary shaft of the upper polishing plate 103, and an optical fiber rotary joint 117 so as to measure the thickness of the wafer W.

However, the above described conventional technologies have following problems.

In Japanese Patent Gazette No. 7-52032, a large ring-shaped bearing 102, which supports the lower polishing plate 100, is provided on the lower polishing plate 100 side, and the bearing 102 supports a center part of the wafer W so as to uniformly apply a polishing load to the wafer W and reduce vibration and axial runout. With this structure, the transparent window 112 must be provided in the vicinity of an outer edge of the lower polishing plate 100. Therefore, only the thickness of the outer part of the wafer W can be measured, but the thickness of the center part thereof cannot be measured.

In Japanese Patent Gazette No. 2005-19920, the thickness measuring equipment 114 including a light-receiving sensor is directly fixed on the upper polishing plate 103. With this structure, the sensor will be badly influenced by rotation and vibration of the upper polishing plate 103, so sensed data will be varied and reliability of the thickness measuring equipment 114 will be lowered. Further, a halogen light is used as a light source of an optical sensor, so a focal point of the light must be widened. Therefore, a distance to the wafer W must be about 100 mm or less.

SUMMARY OF THE INVENTION

The present invention was conceived to solve the above described problems.

An object of the present invention is to provide a double-side polishing apparatus for polishing both faces (a lower face and an upper face) of a wafer, which is capable of reliably measuring not only a thickness of an outer part of the wafer but also a thickness of a center part thereof.

To achieve the object, the present invention has following structures.

Namely, a double-side polishing apparatus for polishing both faces of a wafer comprises: a lower polishing plate whose upper face acts as a polishing face; an upper polishing plate whose lower face acts as a polishing face; a frame holding the upper polishing plate above the lower polishing plate, the frame vertically moving the upper polishing plate; a carrier being provided between the lower polishing plate and the upper polishing plate, the carrier having a through-hole, in which the wafer is held; a plate driving unit for rotating the lower polishing plate and the upper polishing plate about their axes; a carrier driving unit for rotating the carrier; and a slurry supply unit, the lower polishing plate, the upper polishing plate and the carrier are rotated with supplying slurry to the lower polishing plate so as to polish the both faces of the wafer, a window section, through which a laser beam passes, is formed in a part of the upper polishing plate, under which the wafer held by the carrier passes, an optical thickness measuring equipment is provided to a part of the frame, under which the window section of the upper polishing plate passes while the upper polishing plate is rotated, and the thickness measuring equipment emits the laser beam through the window section, receives reflected beams reflected from an upper face and a lower face of the wafer, and calculates the thickness of the wafer on the basis of peak values of the reflected beams.

In the double-side polishing apparatus, the thickness measuring equipment may comprise: a light-emitting section for emitting a laser beam through the window section; an objective lens being moved, by a lens driving unit, so as to focus the laser beam, which is emitted from the light-emitting section, on the upper face and the lower face of the wafer, which is located under the window section; a light-receiving section for receiving the reflected laser beams, which have been reflected on the upper face and the lower face of the wafer; and a calculating section receiving light-receiving signals sent from the light-receiving section and calculating the thickness of the wafer on the basis of the peak values of the reflected beams.

The double-side polishing apparatus may further comprise a slurry cover preventing slurry from scattering, and the thickness measuring equipment may be provided outside of the slurry cover.

In the double-side polishing apparatus, a plurality of the window sections may be arranged on a circumference in the upper polishing plate.

The double-side polishing apparatus may further comprise: a sensor for detecting a rotational position of the upper polishing plate; and a control section for emitting the laser beam when the window section passes are located immediately under the thickness measuring equipment.

In the double-side polishing apparatus, the carrier may be engaged with a sun gear and an internal gear so as to orbit the sun gear and rotate on its axis.

In the double-side polishing apparatus, the window section may be formed at a prescribed position of the upper polishing plate, under which a center of a through-hole of the carrier passes.

In the double-side polishing apparatus of the present invention, the thickness of the wafer can be measured while polishing the wafer, and the wafer can be accurately polished to have the correct thickness. Since a coherent laser beam is used as a measuring light, the thickness measuring equipment can be provided to the frame separated from the upper polishing plate, so that the thickness can be accurately measured without being badly influenced by rotation, vibration, etc. of the upper polishing plate. Further, there are few spatial obstructions in a space above the upper polishing plate, so that the window section can be optionally formed in the upper polishing plate.

Therefore, the thickness of the center part of the wafer too can be measured, so that the thickness of the wafer can be reliably measured.

BRIEF DESCRIPTION OF THE DRAWINGS

Embodiments of the present invention will now be described by way of examples and with reference to the accompanying drawings, in which.

DETAILED DESCRIPTION OF THE EMBODIMENTS

Preferred embodiments of the present invention will now be described in detail with reference to the accompanying drawings.

Figure 1:
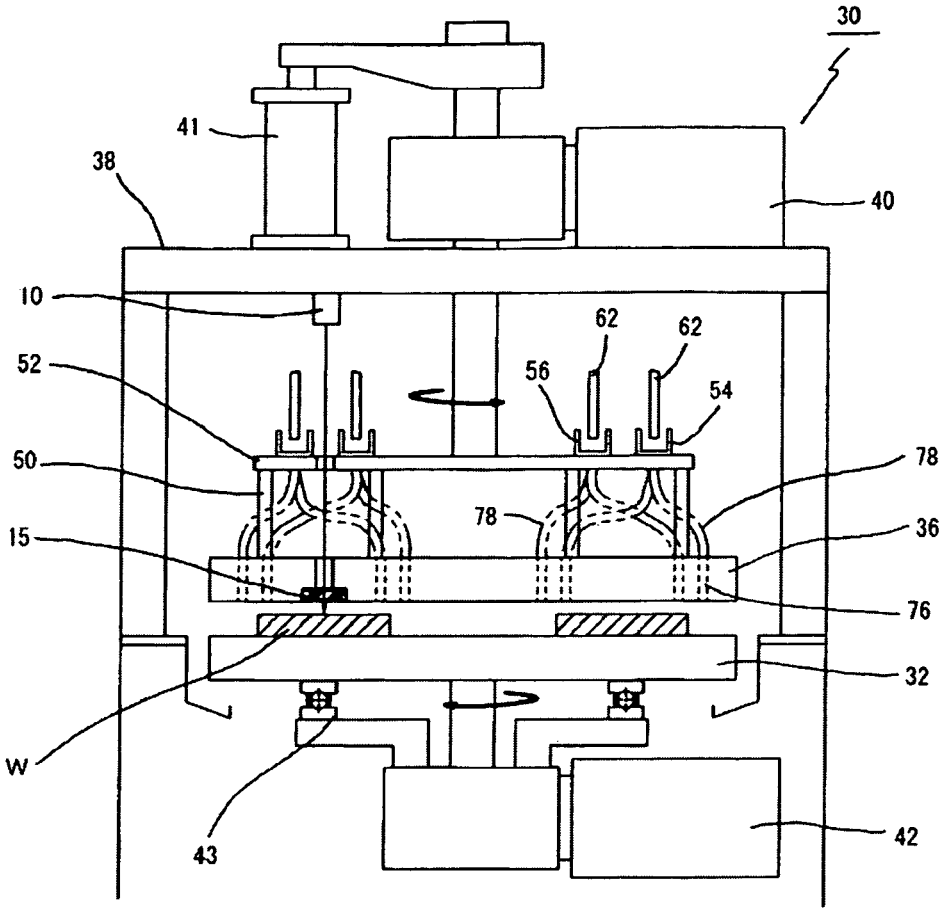
FIG. 1 is a front explanation view of an embodiment of a double-side polishing apparatus of the present invention.

FIG. 1 is a front explanation view of an embodiment of a double-side polishing apparatus 30 of the present invention.

The double-side polishing apparatus 30 has: a lower polishing plate 32, whose upper face is a polishing face; and an upper polishing plate 36, whose lower face is a polishing face and which is provided above the lower polishing plate 32 and capable of moving upward and downward.

The polishing plates 32 and 36 are rotated, in the opposite directions, by plate driving units 40 and 42. The upper polishing plate 36 is rotated about its own axis by the driving unit 40, e.g., motor, which is provided to a frame 38. The upper polishing plate 36 is moved upward and downward by a vertical driving mechanism, e.g., a cylinder unit 41.

The lower polishing plate 32 is rotated about its own axis by the driving unit 42, e.g., motor. A bottom face of the lower polishing plate 32 is supported by a ring-shaped bearing 43.

Figure 2:
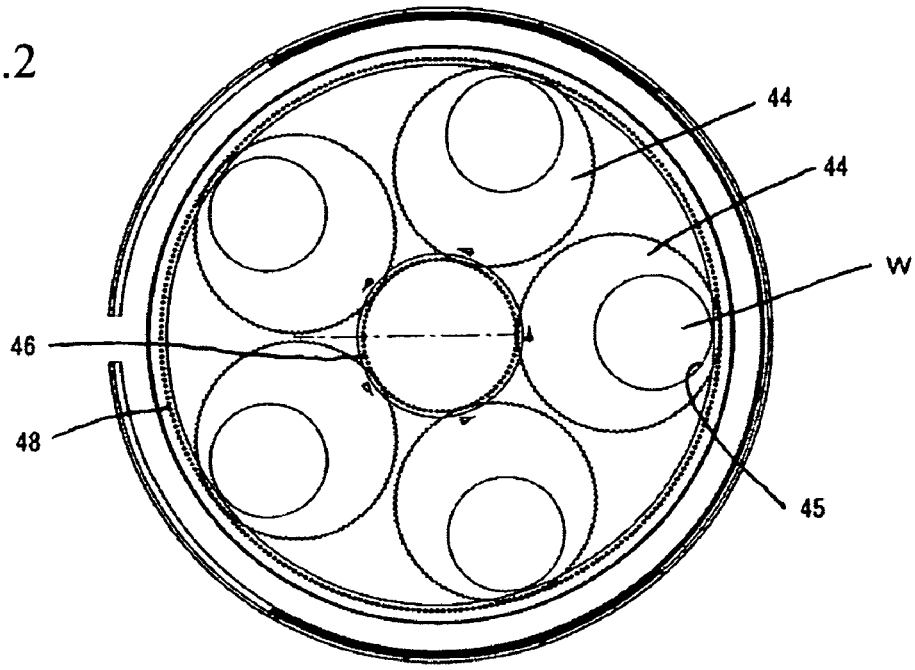
FIG. 2 is an explanation view of a carrier.
Figure 3:
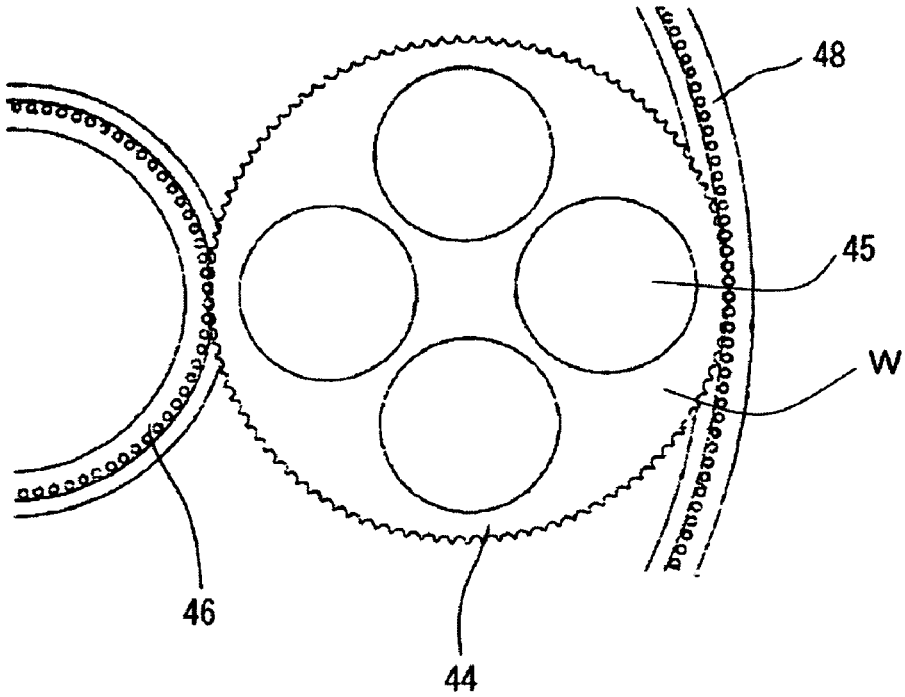
FIG. 3 is an explanation view of another carrier.

Carriers 44, each of which has a through-hole 45 for holding a wafer W, are provided or sandwiched between the lower polishing plate 32 and the upper polishing plate 36. The carriers 44 are engaged with a sun gear (an inner pin gear) 46, which is located in a center hole of the lower polishing plate 32, and an internal gear (an outer pin gear) 48 so as to orbit around the sun gear 46 and rotate on their axes (see FIG. 2). The sun gear 46 and the internal gear 48 are rotated by known mechanisms (not shown). In the present embodiment, one through-hole 45 is eccentrically formed in each of the carriers 44, but forming the through-hole is not limited to the embodiment. For example, as shown in FIG. 3, a plurality of the thorough-holes 45 may be formed in each of the carriers 44, and they may be arranged on a circumference.

A rotary plate 52 is provided above the upper polishing plate 36 and connected to the upper polishing plate 36 by a plurality of rods 50. With this structure, the rotary plate 52 is rotated together with the upper polishing plate 36.

A plurality of (e.g., two in the present embodiment) ring-shaped conduits 54 and 56 are coaxially arranged and fixed on the rotary plate 52.

Slurry holes (not shown) are bored in bottom faces of the ring-shaped conduits 54 and 56.

Slurry is supplied from a slurry supply source (not shown) to the ring-shaped conduits 54 and 56 via tubes 62.

Slurry holes 76 are radially formed in the upper polishing plate 36, and the slurry holes 76 of the upper polishing plate 36 are communicated to the slurry holes of the ring-shaped conduits 54 and 56 by pipes 78. With this structure, the slurry is supplied onto the polishing face of the lower polishing plate 32 via the pipes 78.

By rotating the polishing plates 32 and 36 and the carriers 44 with supplying the slurry to the lower polishing plate 32 via the pipe 78, upper faces and lower faces of the wafers W, which are sandwiched between the lower polishing plate 32 and the upper polishing plate 36, can be polished.

Note that, in the present embodiment, two ring-shaped conduits are provided, but number of the ring-shaped conduits is not limited to two. For example, one ring-shaped conduit may be provided, further three or more ring-shaped conduits may be provided.

Figure 4:
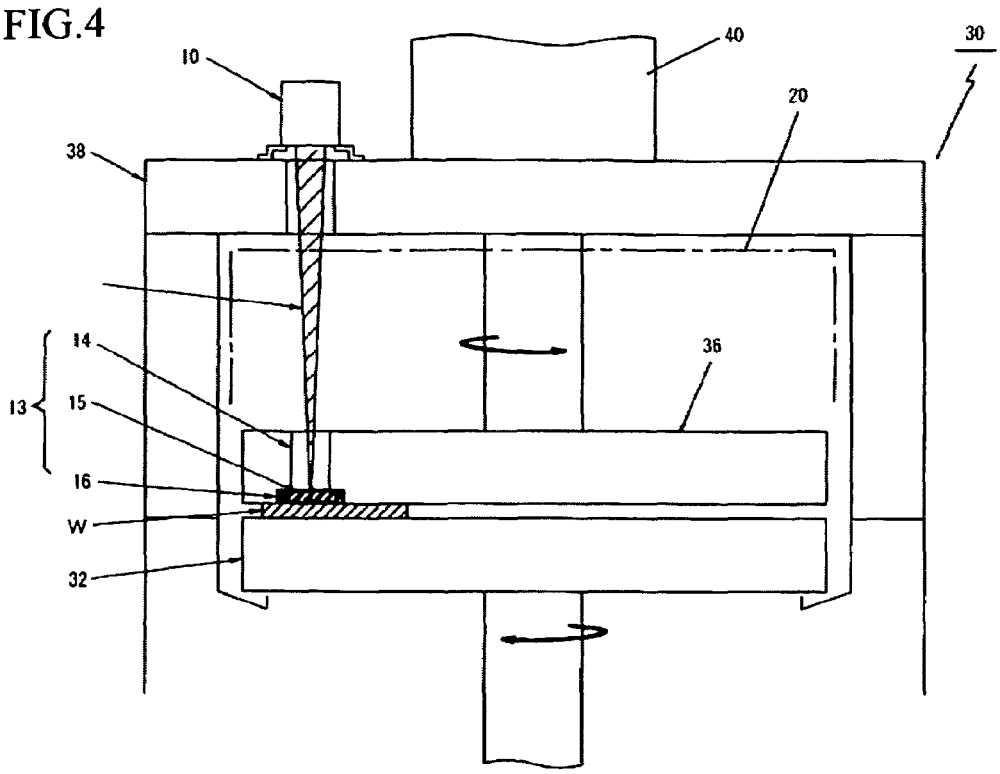
FIG. 4 is a front explanation view of the polishing apparatus having a thickness measuring equipment.
Figure 5:
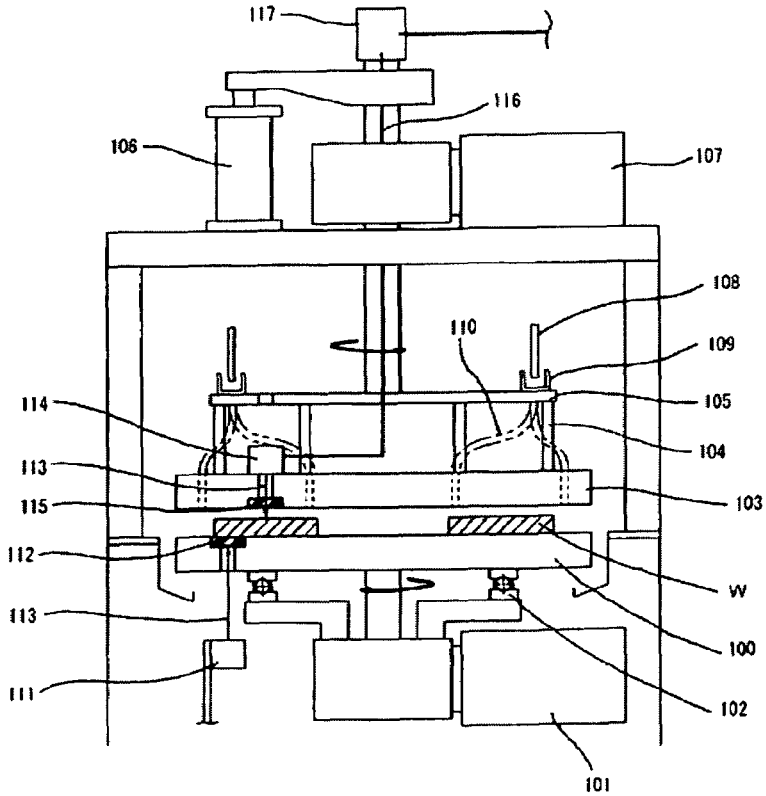
FIG. 5 is an explanation view of the conventional double-side polishing apparatus.

FIG. 4 is a front explanation view of the double-side polishing apparatus 30 having a thickness measuring equipment 10. The double-side polishing apparatus 30 is the same as the apparatus 30 shown in FIG. 1. Thus, only the upper polishing plate 36 held by the frame 38 and the lower polishing plate 32 are shown in FIG. 4, but other members are omitted therein.

In the embodiment shown in FIG. 4, the thickness measuring equipment 10, which measures thicknesses of the wafers W, is provided on the upper polishing plate 36 side.

A window section 13, through which a laser beam passes, is formed in a part of the upper polishing plate 36, under which the wafers W held by the carriers 44 (not shown in FIG. 4) passes. The window section 13 is constituted by a through-hole 14 formed in the upper polishing plate 36 and a shield plate 15, which is made of glass and fitted in the through-hole 14. A gap between the through-hole 14 and the shield plate 15 are sealed by a rubber sealing member 16.

Preferably, a diameter of the window section 13 is about 10-15 mm.

A plurality of the window sections 13 may be arranged on a circumference in the upper polishing plate 36.

The optical thickness measuring equipment 10 is provided to a part of the frame 38, under which the window section 13 passes while rotating the upper polishing plate 36.

The optical thickness measuring equipment 10 is a known equipment.

Namely, the thickness measuring equipment 10 comprises: a light-emitting section (not shown) for emitting a laser beam through the window section 13; an objective lens (not shown) being moved, by a lens driving unit (not shown), so as to focus the laser beam, which is emitted from the light-emitting section, on the upper face and the lower face of the object wafer W, which is located under the window section 13; a light-receiving section for receiving the reflected laser beams, which are reflected on the upper face and the lower face of the wafer W; and a calculating section (not shown) receiving light-receiving signals (light-intensity signals) sent from the light-receiving section and calculating the thickness of the object wafer W on the basis of the peak values (peak light intensities) of the reflected beams.

In the double-side polishing apparatus, a slurry cover 20 covers the upper polishing plate 36 so as to prevent slurry from scattering.

As shown in FIG. 4, the thickness measuring equipment 10 is provided to a part of the frame 38, which is located outside of the slurry cover 20. With this structure, the thickness measuring equipment 10 is not contaminated by slurry.

In the double-side polishing apparatus of the present embodiment, by rotating the polishing plates 32 and 36 and the carriers 44 with supplying the slurry to the lower polishing plate 32 via the pipe 78, the upper faces and the lower faces of the wafers W, which are sandwiched between the lower polishing plate 32 and the upper polishing plate 36, can be simultaneously polished.

Successively, measuring the thickness of the wafer W will be explained.

A laser beam in the infrared region, which has spectrum between a wavelength of 1 μm and a wavelength of 2 μm, is emitted from the light-emitting section through the window section 13. The infrared laser beam in said wavelength region passes through the glass shield plate 15 and the silicon wafer W and is reflected on each boundary face. Namely, the laser beam is strongly reflected on an upper face of the shield plate 15, a lower face of the shield plate 15, the upper face of the wafer W and the lower face of the wafer W. The thickness of the wafer W can be calculated on the basis of a relationship between "peak (intensity) values" of the reflected beams reflected on the upper face and the lower face of the wafer W" and "a moving distance of the objective lens". When the thickness of the wafer W reaches a prescribed thickness, the wafer polishing process is terminated.

The laser beam emitted from the light-emitting section enters the window section 13 via a through-hole bored in the frame 38 and a through-hole bored in the cover 20. Even if the rotary plate 52 cuts across a light path, a through-hole is formed in the rotary plate 52, so that the laser beam can pass through the rotary plate 52.

In the present embodiment, the laser beam is always emitted from the light-emitting section, but the upper polishing plate 36 is rotated. So the laser beam cannot always pass through the window section 13. When the laser beam cannot pass through the window section 13, the reflected beam is not strong, so the intensity datum is regarded as an error datum and not plotted. In a case, the wafer W is not located under the window section 13 but the carrier 44 is located under the window section 13 because the wafer W is moved together with the carrier 44. In this case too, the reflected beam reflected on the carrier 44 is weak, so the intensity datum is regarded as an error datum and not plotted.

As described above, the laser beam may be always emitted from the light-emitting section, but not limited to the above described example. For example, a sensor (not shown) for detecting the rotational position of the upper polishing plate 36 may be provided, and a control section (not shown) may control the light-emitting section to emit the laser beam when the window section 13 passes an area located immediately under the thickness measuring equipment 10. In this case, disturbance can be preferably prevented.

In the double-side polishing apparatus shown in FIG. 1, the ring-shaped bearing 43 supporting the lower polishing plate 32, etc. are provided under the lower polishing plate 32, so it is spatially difficult to provide the thickness measuring equipment 10 under the lower polishing plate 32.

The rotary plate 52, the pipes 78, etc. are provided above the upper polishing plate 36, but the window section 13 can be formed in the part of the upper polishing plate 36, in which the window section 13 is not interrupted by said members.

Note that, depending on the size of the apparatus 30, a space of 100-130 cm is formed between the frame 38 and the upper polishing plate 36. In the present embodiment, even if there is such distance between the thickness measuring equipment 10 and the wafer W to be measured, the thickness of the wafer W can be well measured by using the coherent laser beam.

As described above, it is not spatially difficult to form the window section 13 on the upper polishing plate 36 side. The window section 13 and the thickness measuring equipment 10 may be provided to a prescribed position, under which a center of the through-hole 45 of the carrier 44 passes. With this structure, a thickness of the center part of the wafer W, which is held by and moved together with the carrier 44 shown in FIG. 2 or 3, can be measured. Therefore, the thickness of the radially outer part of the wafer W and the center part thereof can be measured.

Note that, in the present application, the concept of the polishing apparatus includes a lapping apparatus. Therefore, the scope of the present invention includes not only polishing apparatuses but also lapping apparatuses.

The invention may be embodied in other specific forms without departing from the spirit of essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A double-side polishing apparatus for polishing upper and lower faces of a wafer, comprising:

a lower polishing plate having an upper face capable of acting as a polishing face;

an upper polishing plate having a lower face capable of acting as a polishing face;

a frame holding said upper polishing plate above said lower polishing plate, said frame capable of moving said upper polishing plate in a vertical direction;

a carrier being provided between said lower polishing plate and said upper polishing plate, said carrier having a through-hole, in which the wafer is held;

a plate driving unit for rotating said lower polishing plate and said upper polishing plate about their axes;

a carrier driving unit for rotating said carrier; and a slurry supply unit, wherein said lower polishing plate, said upper polishing plate and said carrier are rotated while supplying slurry to said lower polishing plate so as to polish the upper and lower faces of the wafer, a window section, through which a laser beam passes, is formed in a part of said upper polishing plate, under which the wafer held by said carrier passes, an optical thickness measuring equipment is provided to a part of said frame, the window section of said, upper polishing plate passing under the optical thickness measuring equipment while said upper polishing plate is rotated, and said thickness measuring equipment being adapted to emit the laser beam through the window section, to receive reflected beams reflected from an upper face and a lower face of the wafer, and to calculate a thickness of the wafer based on peak values of the reflected beams.

2. The double-side polishing apparatus according to claim 1, further comprising a slurry cover adapted to prevent slurry from scattering, wherein said thickness measuring equipment is provided outside of said slurry cover.

3. The double-side polishing apparatus according to claim 1, wherein the window section includes a plurality of said window sections arranged adjacent to a circumferential edge of said upper polishing plate.

4. The double-side polishing apparatus according to claim 1, further comprising:

a sensor capable of detecting a rotational position of said upper polishing plate; and a control section capable of emitting the laser beam when said window section passes immediately under said thickness measuring equipment.

5. The double-side polishing apparatus according to claim 1, wherein said carrier is engaged with a sun gear and an internal gear so as to orbit around the sun gear and rotate on its own axis.

6. The double-side polishing apparatus according to claim 5, wherein said window section is formed at a prescribed position of said upper polishing plate, under which a center of a through-hole of said carrier passes.

* * * * *